United States Patent [19]

Linnell et al.

[11] Patent Number: 4,791,391

[45] Date of Patent: Dec. 13, 1988

[54] PLANAR FILTER CONNECTOR HAVING THICK FILM CAPACITORS

[75] Inventors: Thomas D. Linnell, Mechanicsburg; Arthur T. Murphy, Hershey; Frederick J. Young, Bradford, all of Pa.

[73] Assignee: E. I. Du Pont De Nemours and Company, Wilmington, Del.

[21] Appl. No.: 812,301

[22] Filed: Dec. 23, 1985

Related U.S. Application Data

[63] Continuation-in-part of Ser. No. 480,593, Mar. 30, 1983, abandoned.

[51] Int. Cl.[4] ..... H01P 13/648

[52] U.S. Cl. ..... 333/184; 333/185; 361/302; 361/329; 361/312; 439/607; 439/620

[58] Field of Search ..... 333/182–185; 339/143 R, 147 R; 361/302, 303, 306, 309, 311, 312, 328–330; 439/607, 620

[56] References Cited

U.S. PATENT DOCUMENTS

| | | | |
|---|---|---|---|
| 3,267,342 | 8/1966 | Pratt, Jr. et al. | 361/321 |
| 3,490,055 | 1/1970 | Cox | 333/172 |
| 3,496,435 | 2/1970 | Manley | 361/301 |
| 3,538,464 | 11/1970 | Walsh | 361/302 X |
| 3,544,434 | 12/1970 | Giller et al. | 204/38.4 |
| 3,582,729 | 6/1971 | Girard | 29/25.42 X |
| 3,600,652 | 8/1971 | Riley | 361/321 |
| 3,679,943 | 7/1972 | Bergmann | 361/433 |
| 3,710,285 | 1/1973 | Schor et al. | 333/182 |
| 3,714,709 | 2/1973 | Liederbach | 29/626 |
| 3,745,431 | 7/1973 | Imamura et al. | 29/25.42 X |
| 3,746,662 | 7/1973 | Adelman | 252/513 |
| 3,753,170 | 8/1973 | Holland | 333/81 R |
| 3,864,159 | 2/1975 | Field et al. | 361/321 |
| 3,900,773 | 8/1975 | Bowkley et al. | 361/303 |
| 3,996,502 | 12/1976 | Bratschun | 361/321 |
| 4,007,296 | 2/1977 | Ansell et al. | 29/25.42 X |
| 4,020,430 | 4/1977 | Vander Heyden | 333/183 |
| 4,030,004 | 6/1977 | Rutt | 361/313 |
| 4,079,343 | 3/1978 | Nijman | 333/182 |
| 4,083,022 | 4/1978 | Nijman | 333/183 |
| 4,126,840 | 11/1978 | Selvin | 333/182 X |
| 4,144,509 | 3/1979 | Boutros | 333/182 X |
| 4,181,903 | 1/1980 | Holland et al. | 333/81 R |
| 4,187,481 | 2/1980 | Boutros | 333/182 |
| 4,220,547 | 9/1980 | Abe et al. | 252/576 |
| 4,241,378 | 12/1980 | Dorrian | 361/305 |
| 4,262,268 | 4/1981 | Shimada et al. | 333/182 |
| 4,274,124 | 6/1981 | Feinberg et al. | 361/275 |
| 4,276,523 | 6/1981 | Boutros et al. | 333/182 |
| 4,308,571 | 12/1981 | Tanei et al. | 361/321 |
| 4,349,862 | 9/1982 | Bajorek et al. | 361/329 X |
| 4,356,530 | 10/1982 | Sato et al. | 361/321 |
| 4,362,350 | 12/1982 | Von Harz | 439/607 |
| 4,407,552 | 10/1983 | Watanabe et al. | 333/182 X |
| 4,424,551 | 1/1984 | Stevenson et al. | 361/302 |
| 4,457,574 | 6/1984 | Walters | 439/607 |
| 4,494,092 | 1/1985 | Griffin | 333/182 |

FOREIGN PATENT DOCUMENTS

| | | | |
|---|---|---|---|
| 1138944 | 1/1983 | Canada . | |
| 2925374 | 10/1980 | Fed. Rep. of Germany . | |
| 3016315 | 11/1981 | Fed. Rep. of Germany . | |
| 3222938 | 1/1983 | Fed. Rep. of Germany | 361/328 |

OTHER PUBLICATIONS

Abe, K et al., "Development of the Thick Film Capacitor and Its Application for Hybrid Circuit Modules"; *Proceedings Electronic Component Conf.*; 1979; pp. 277–285.

Sproull et al., A High Performance Thick Film Capacitor System, Proceedings: Electronic Components Conf. 1978, pp. 38–46.

Viclan New Product Bulletin No. 4A, Introducing the P.C.A. Planar Capacitor Array.

Boutros, A New Approach to the Design of EMI Filter Connectors Using Planar Filters, Proceedings: Twelfth Annual Connector Symposium, 1979, pp. 222–226.

*Primary Examiner*—Eugene R. Laroche

*Assistant Examiner*—Benny T. Lee

[57] ABSTRACT

A filter connector for attentuating electromagnetic interference up to 1000 MHz having a housing, a filter element enclosed within the housing and electrically conductive pins mounted within the filter element. The filter element contains an alumina substrate with thick film layers of a metallization forming pin and ground electrodes, and a dielectric layer separating the electrodes screen printed over the substrate and a glass encapsulant. The ground electrode extends to the periphery of the substrate and is continuous except for clearance holes at the locations of pins.

14 Claims, 11 Drawing Sheets

PLANAR FILTER CONNECTOR HAVING THICK FILM CAPACITORS

CROSS-REFERENCE

This is a continuation-in-part of our copending application Ser. No. 480,593, filed Mar. 30, 1983 now abandoned.

BACKGROUND

This invention relates to a pin filter connector for reducing electromagnetic interference in electrical devices by attenuating various frequencies applied to the pin. More particularly, it refers to a filter connector having a series of thick film capacitors with holes within the various elements of the capacitors, each accommodating an electrically conductive pin.

Filter connectors for attenuating high frequency interference from electrical devices are well known from several patents, e.g., U.S. Pat. Nos. 3,538,464, 4,126,840, 4,144,509 and 4,187,481. In each of these patents, a capacitor employed in the filter is a series of ceramic layers forming a monolithic structure. Thick film capacitors are also well known from U.S. Pat. No. 4,274,124. Although monolithic capacitors are currently used in filter connectors, it has not been practical heretofore to substitute thick film capacitors such as shown in U.S. Pat. No. 4,274,124 for these monolithic capacitors. Problems have occurred in designing a thick film capacitor for a filter connector which has a low enough inductance to attenuate high frequencies.

In recent years, the common usage of computers and particularly home computers has resulted in the generation of significant additional amounts of high frequency electromagnetic signals interfering with other electrical devices. For the purpose of reducing the output of such signals, the United States Federal Communications Commission (FCC) has promulgated regulations requiring attenutation at their source. See 47 CFR 15, Subpart J.

Available monolithic capacitor structures used in filters are not cost effective for use in electronic equipment such as the personal computer. Furthermore, such structures have low strength and frequently crack or fracture during fabrication or installation and even in use. Accordingly, what is needed is a filter connector employing thick film capacitors of low inductance. In this regard, a useful commercial filter attenuates electromagnetic signals at least 30 decibels (dB) at a frequency of 1000 megahertz ($MH_z$).

SUMMARY OF THE INVENTION

This invention is a cost effective electrical filter connector for filtering a wide band of frequencies up to 1000 MHz using a particular design of thick film capacitors in repeating sequence to form the filter element. The filter element comprises a multiplicity of closely spaced thick film capacitors, each one having a conductive pin mounted in a hole through a capacitor. The capacitor has multiple layers of screen printed materials over a high strength alumina substrate having upper and lower parallel surfaces.

One layer is a metallization forming a ground electrode. This electrode is grounded to the connector housing. It extends to the periphery of the alumina substrate and is continuous except for holes sufficient in size to accommodate the conductive pins but without touching any of the pins.

Another layer is a metallization forming a pin electrode, but its area is limited to a portion around a given hole in the substrate. This layer is in electrical contact with the pin through a solder joint.

In between the two electrodes is a layer, dielectric in nature, applied directly over one of the electrodes. This layer overlaps the first layer, separates the electrodes and has holes sufficient in diameter to allow the conductive pins to pass without touching the dielectric.

A fourth and last layer is a nonconductive encapsulant for excluding moisture covering all layers except electrical contacting or soldering areas.

BRIEF DESCRIPTION OF THE DRAWINGS

The present invention may be best understood by those having ordinary skill in the art by reference to the following detailed description when considered in conjunction with the accompanying drawings in which:

FIG. 9 is a graph showing an attentuation curve (a) for a filter connector where the ground electrode does not cover the substrate compared to a curve (b) for filter connectors of the type shown in FIGS. 1–7;

DESCRIPTION OF THE INVENTION

Figure 1:
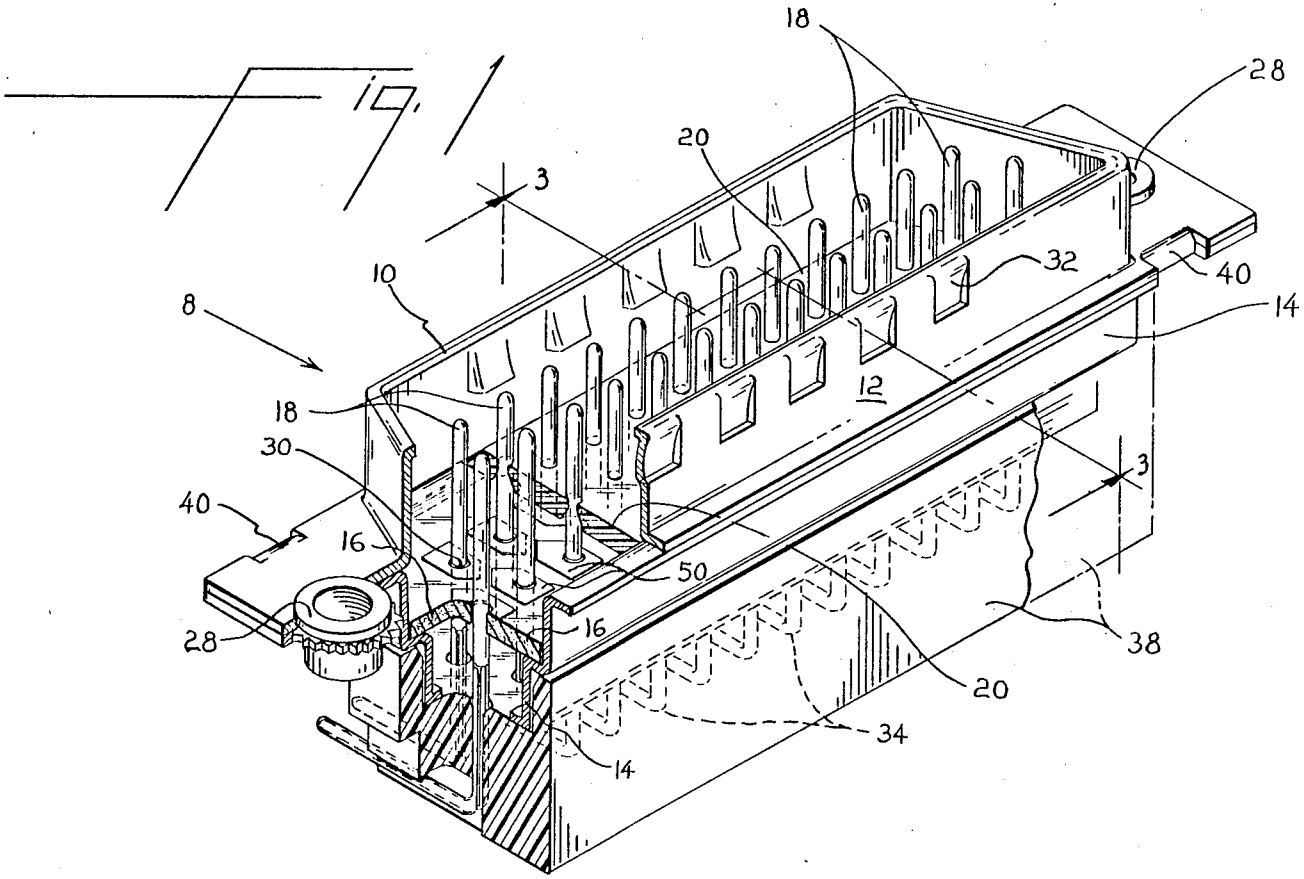
FIG. 1 is an isometric view of an assembly, partially sectioned, of the filter connector.
Figure 2:
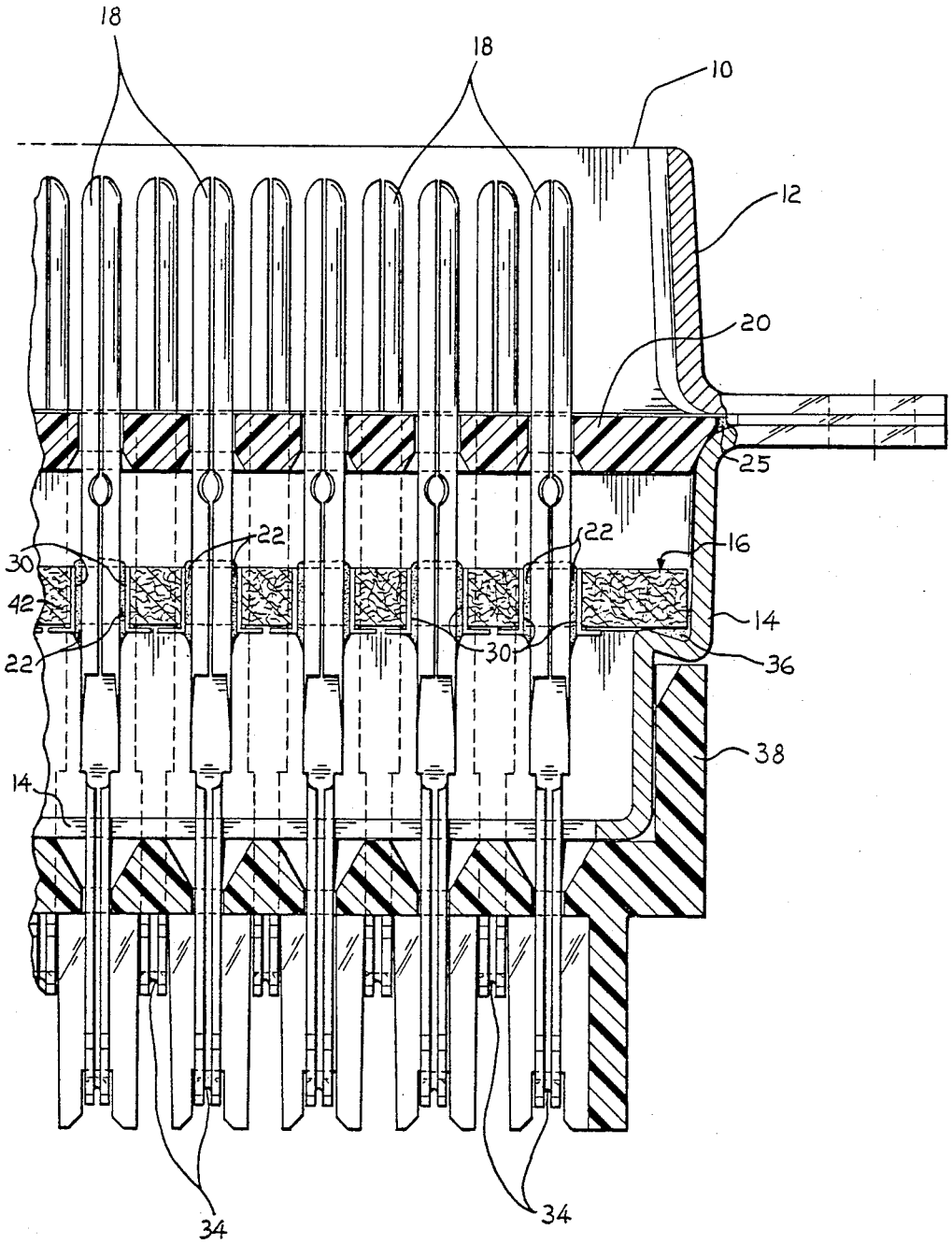
FIG. 2 is a partial elevational view of the filter connector in section.
Figure 3:
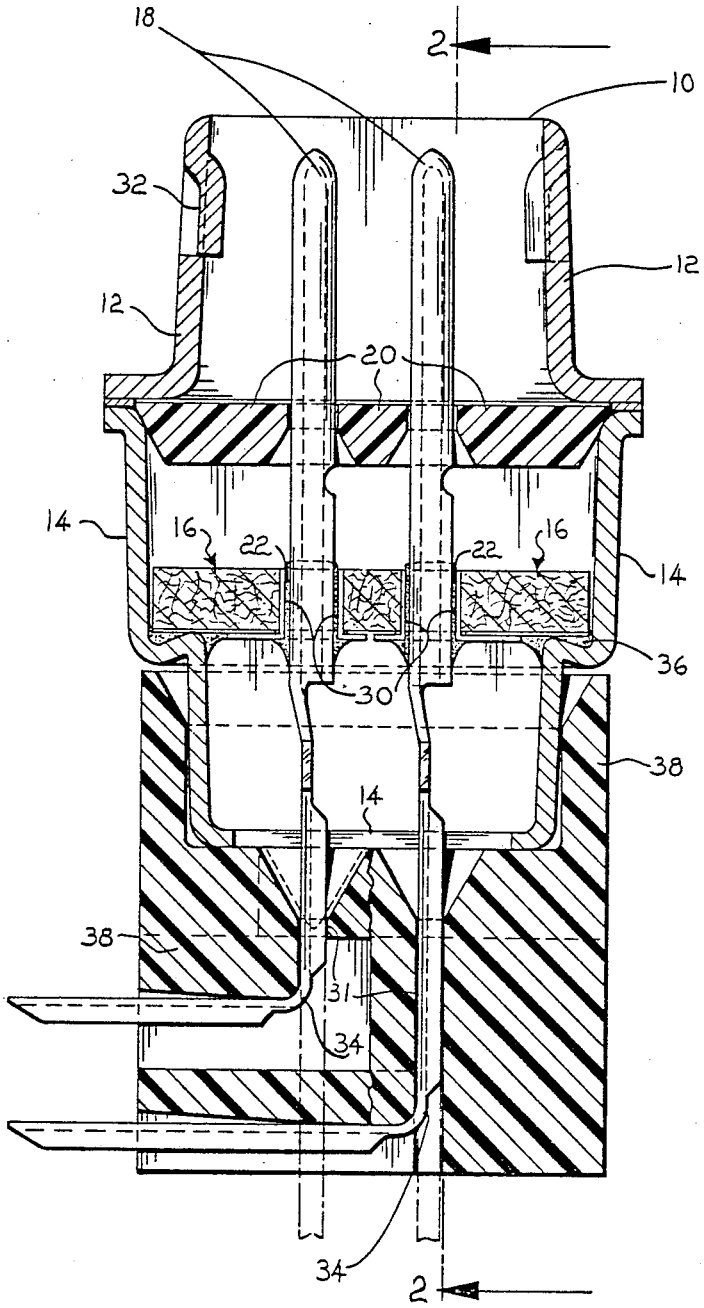
FIG. 3 is a transverse sectional view along line 3—3 of the filter connector of FIG. 1.

Referring to FIGS. 1–3, a filter connector 8 includes a conductive housing 10 having a top shell 12 and a bottom shell 14. Housing 10 encloses two rows of pins 18 mounted on a filter element 16. The interior of connector 8 is protected by a top insulator 20 and a bottom insulator 38. Pins 18 are individually mounted on filter element 16 by solder joints 22.

Threaded inserts 28 can be included in the connector optionally to provide a mounting fixture to a cabinet. Ground contacts 32 are made available on the top shell 12 to provide a ground contact for a female plug (not shown) inserted over the pins 18. The two shells 12 and 14 are crimped together by a tab 40. Pins 18 can be either straight or right-angled as shown at 34 in FIG. 3. Holes 31 in the bottom insulator 38 provide bottom exits for pins 18 (see FIG. 3). Holes 30 in the filter element 16 provide the means for passage of pins 18 and the location of solder joint 22 (see FIGS. 2, 3).

Figure 4:
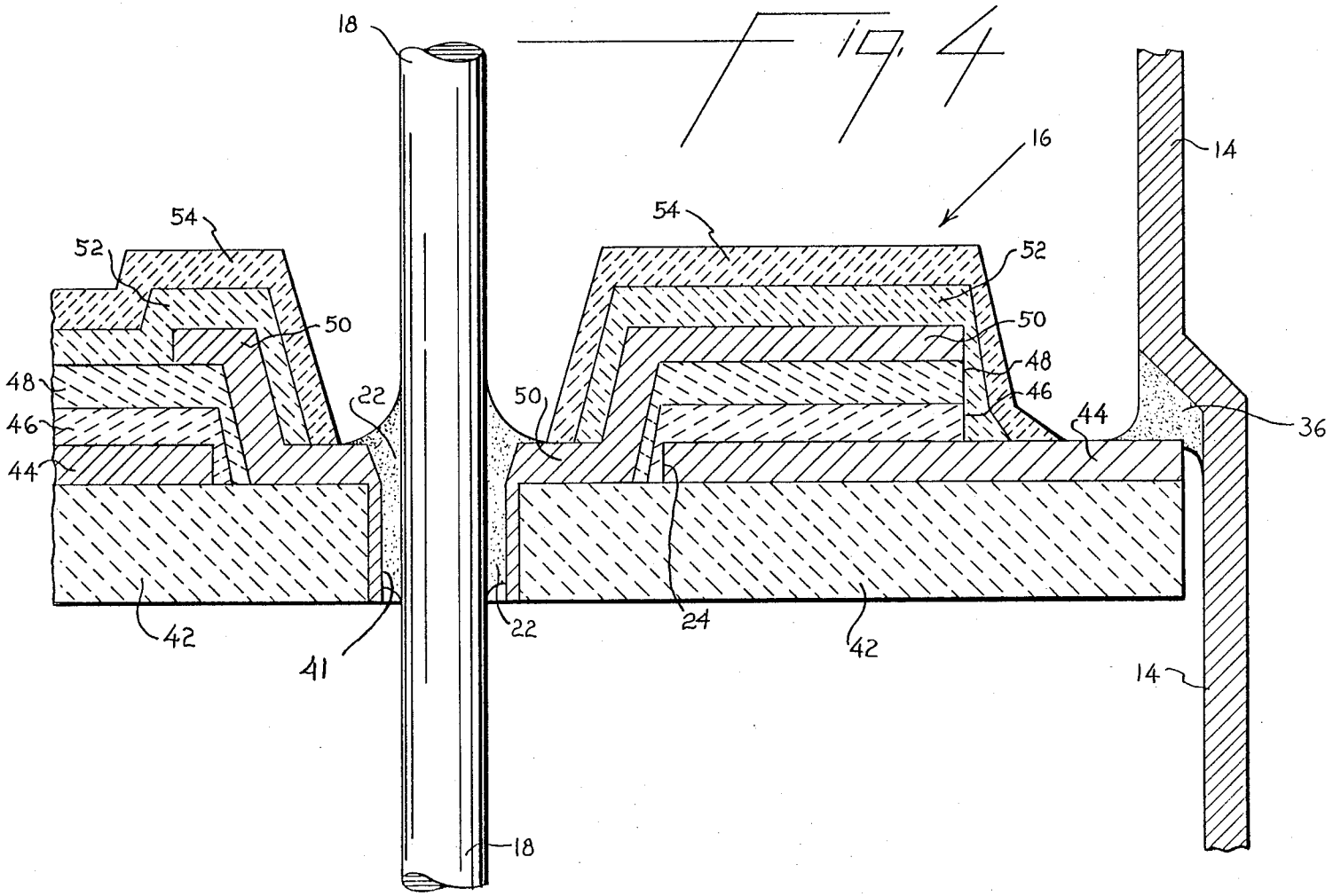
FIG. 4 is a schematic sectional through a single capacitor unit of a filter element assembled to a pin.
Figures 5, 6, 7:
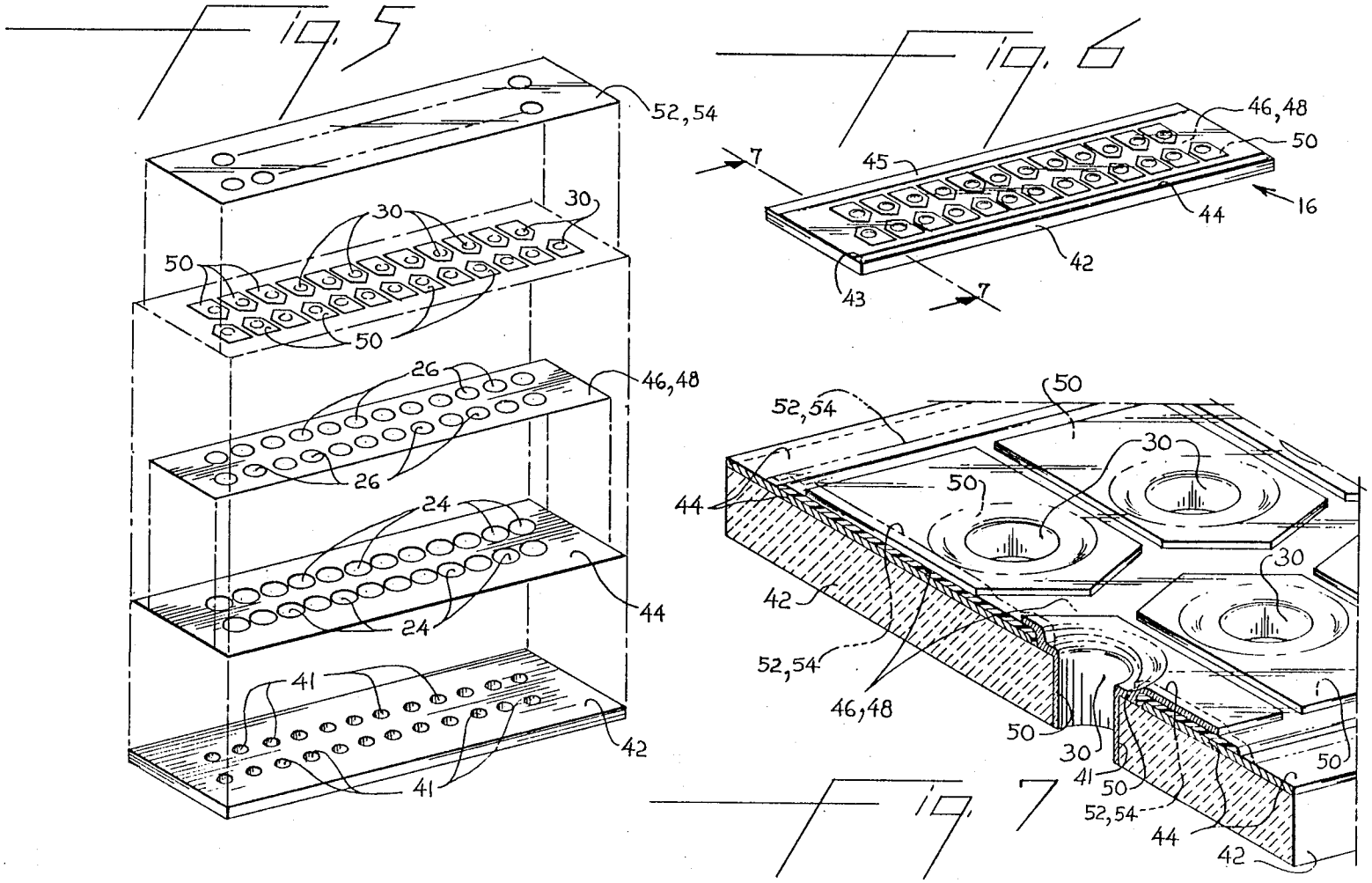
FIG. 5 is an exploded view of a filter element containing multiple capacitor units shown in FIG. 4.
FIG. 6 is a perspective view of the filter element member shown in FIG. 5.
FIG. 7 is an enlarged view in cross section along line 7—7 of FIG. 6.

It is apparent on inspection of FIG. 1 that filter element 16 carries a planar array of capacitors for the pins 18. There is a capacitor for each pin and, as shown in FIGS. 4 and 5, the pins 18 project from solder mounts 22 in holes 41 through a relatively thick, high strength, alumina substrate 42 having opposed, parallel surfaces. A ground electrode in the form of a first metallization layer 44 is screen printed on and, except for holes 24, covers the upper surface of substrate 42. Holes 24 are sufficiently large to allow the conductive pins 18 to pass without touching the ground electrode.

The ground electrode 44 is covered by a screen printed layer of dielectric 46. For purposes of this specification, a single layer of dielectric is mentioned although, in practice, two layers of dielectric 46 and 48 have been screen printed over the ground electrode to provide more than adequate protection against shorting between electrodes. As seen in FIG. 5, the dielectric layer 46, 48 also has holes 26 which are slightly larger than the diameter of the pins 18. The dielectric 46, 48 covers the surface of the electrode 44 except for its exposed longitudinal borders 43, 45 (FIG. 6) which are used for soldering and thereby grounding electrode 44 to the shell 14. The dielectric 46, 48 overlaps and covers the vertical edges of the ground electrode 44, in the holes 24, as seen in FIG. 4.

Metallization layers 50 are screen printed intermittently in a regular pattern over the dielectric layer. This forms a series of pin electrodes 50, each of which is in electrical contact with a pin 18 through a solder joint 22. These electrodes are screen printed in such a manner as to form rows of discrete, spaced, arrowhead-shaped layers distributed over the surface of dielectric 46, 48 as seen in FIGS. 5 and 6. Each electrode 50 covers substrate 42 around and extends through a hole 41 (FIGS. 5 and 7) to the lower surface of the substrate. The pasted holes insure rugged mechanical solder connections 22 for the pins 18.

The last layer, glass encapsulant 52, 54 (FIGS. 4 and 5), covers both the electrodes 50 and dielectric 46, 48. Although only one layer is shown in FIG. 5, in practice two layers of encapsulant are usually screen printed over the electrode 50 for added safety and to match the temperature coefficient of expansion of layers 42, 46, 48. For purposes of this specification, when talking about a layer of encapsulant, one or more layers of encapsulant is meant.

The arrowhead design of the electrode 50 provides a means for closely spacing the capacitors used in the filter connector and, hence, increasing the area of the capacitor for a given size of filter element and therefore its capacitance value. Of course, other designs could be used which satisfy the purpose of producing capacitors of the type employed in this invention.

Metallizations used in this invention are made from pastes containing a finely divided metal powder of either a noble metal or copper, a binder for the metal and a vehicle to disperse the powders evenly. The paste is applied by screen printing methods and the vehicle is removed from the applied composition by firing the screened on layer by conventional techniques. Particularly preferred is a palladium/silver alloy metallization. The dielectric employed can be any type commonly used in capacitors. However, a barium titanate paste having, when fired, a dielectric constant above 1000 is preferred.

The encapsulant can be any one of the types used in capacitors as long as it has a coefficient of expansion compatible with the other components employed.

Figure 8:
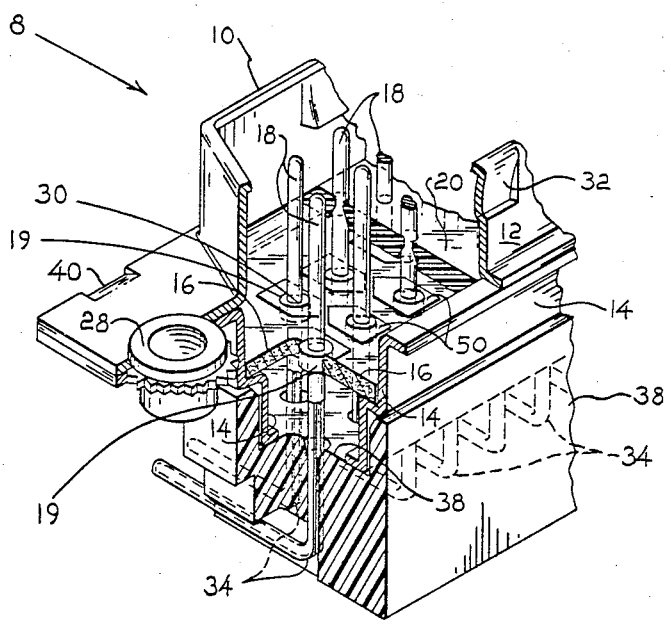
FIG. 8 is a partial sectional view of the filter connector having a ferrite sleeve around each pin.

A ferrite sleeve 19 also can be attached to the pin 18, as seen in FIG. 8. Such sleeves are well known, as seen in U.S. Pat. No. 4,144,509.

Figure 4A:
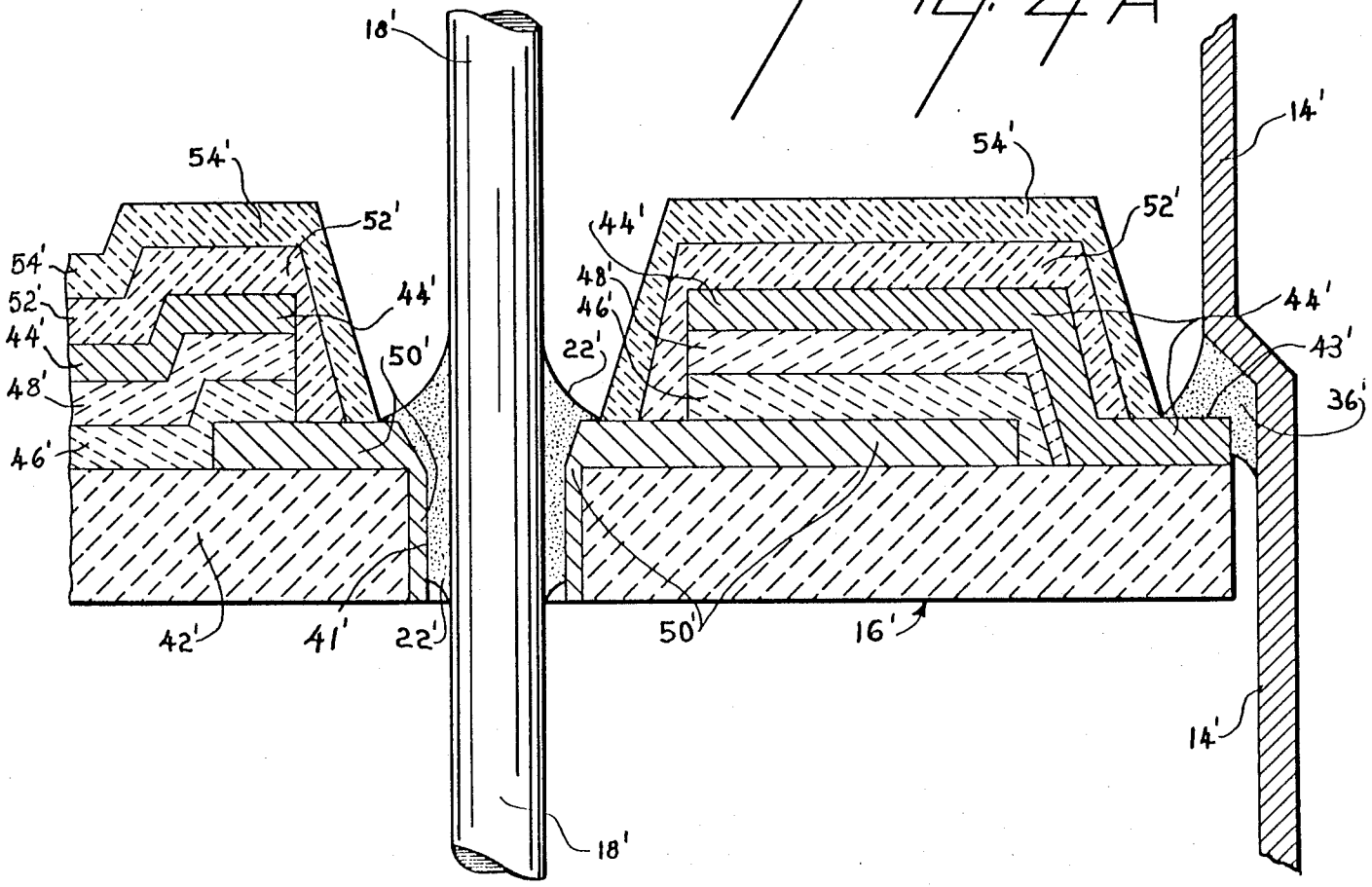
FIG. 4A is a schematic sectional through an alternate embodiment of a single capacitor unit assembed to a pin.

Although FIGS. 4, 5 depict the ground electrode 44 as being applied as the first metallization layer and the pin electrode 50 as the third layer, this can be reversed, as shown in FIG. 4A. Pin electrode 50' is screen printed directly to the alumina 42' around and in each hole 41'. The dielectric layers 46' and 48' are then applied to overlap the layer 50' except for an annular area around each hole 41 (FIG. 5). The ground electrode 44' is screen printed over the layers 46' and 48' and all exposed areas of the upper surface of the alumina substrate 42'. The encapsulant 52', 54' is applied in the same manner as in FIG. 4. The encapsulant covers all exposed surfaces except for longitudinal borders of layer 44' which are solder areas, as shown at 43'.

The low inductance at high frequencies achieved by this invention is a direct result of the geometry of the ground electrode as related to the pin electrode. If the ground electrode and dielectric are placed only to one side of the pin, the attenuation curve (a) of FIG. 9 results. This curve shows a low level of attenuation and hence reduced filtering action above 200 MHz and more particularly above 700 MHz in the ultra high frequency range. The reason for this reduced attenuation is that the capacitor has a series resonance around 200 MHz (shown by the sharp peak in curve (a)) caused by the inductance of the electrodes of the capacitor.

When the ground electrode extends to the periphery of the substrate and is continuous except for holes at the locations of pins, the current flow from the pin can divide into two components flowing toward ground connections on both sides of the filter shell 14. This results in a decreased effective electrode inductance by providing two parallel current paths. The decreased inductance results in an increased series resonant frequency and an increased attenuation such as is shown in curve (b) of FIG. 9. Thus, equivalent levels of attenuation are reached without providing separate ground planes of the type disclosed in U.S. Pat. No. 4,682,129, issued July 21, 1987.

Figure 11:
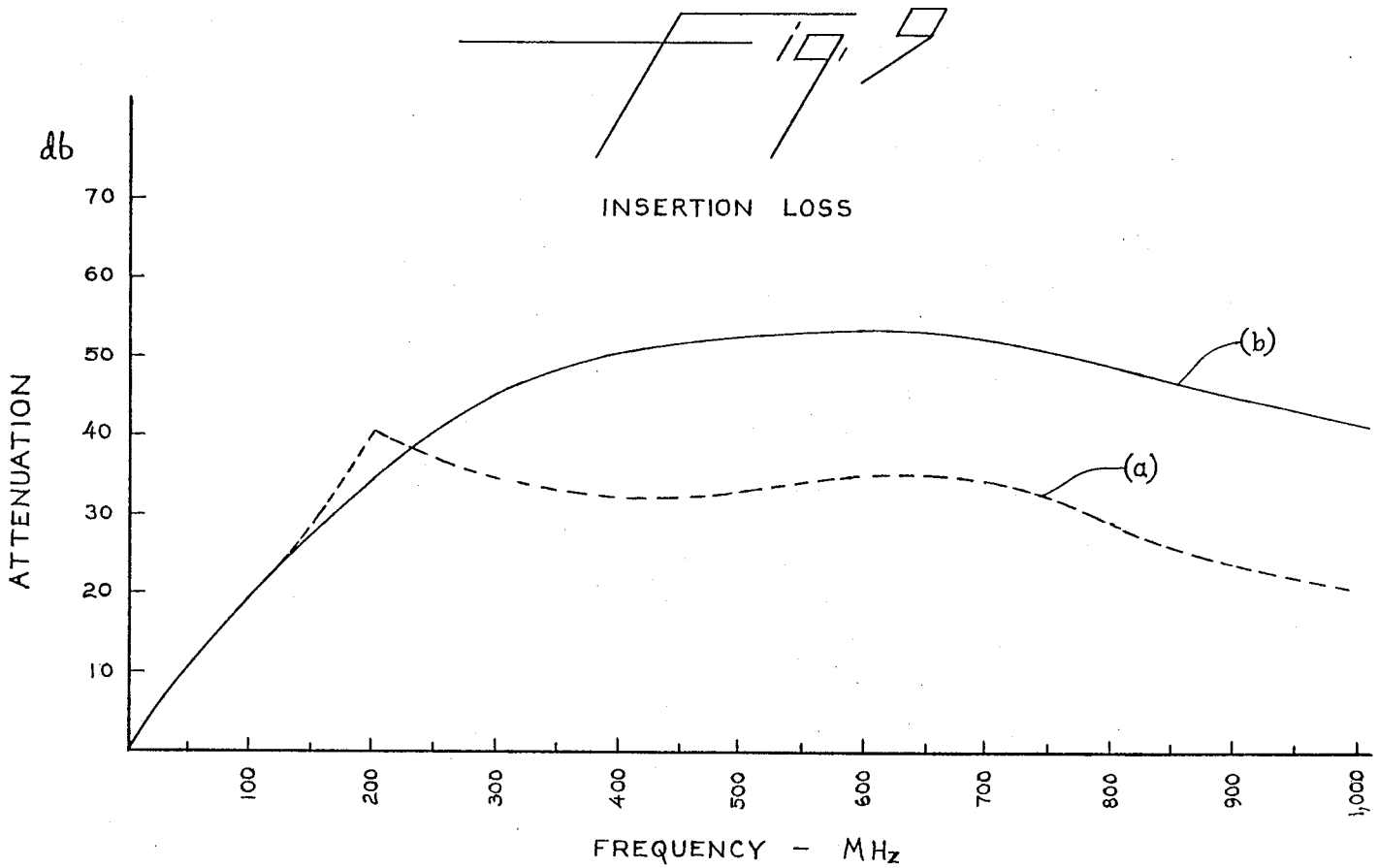
FIG. 11 is a perspective view of a filter element made from the components shown in FIG. 10.
Figure 10:
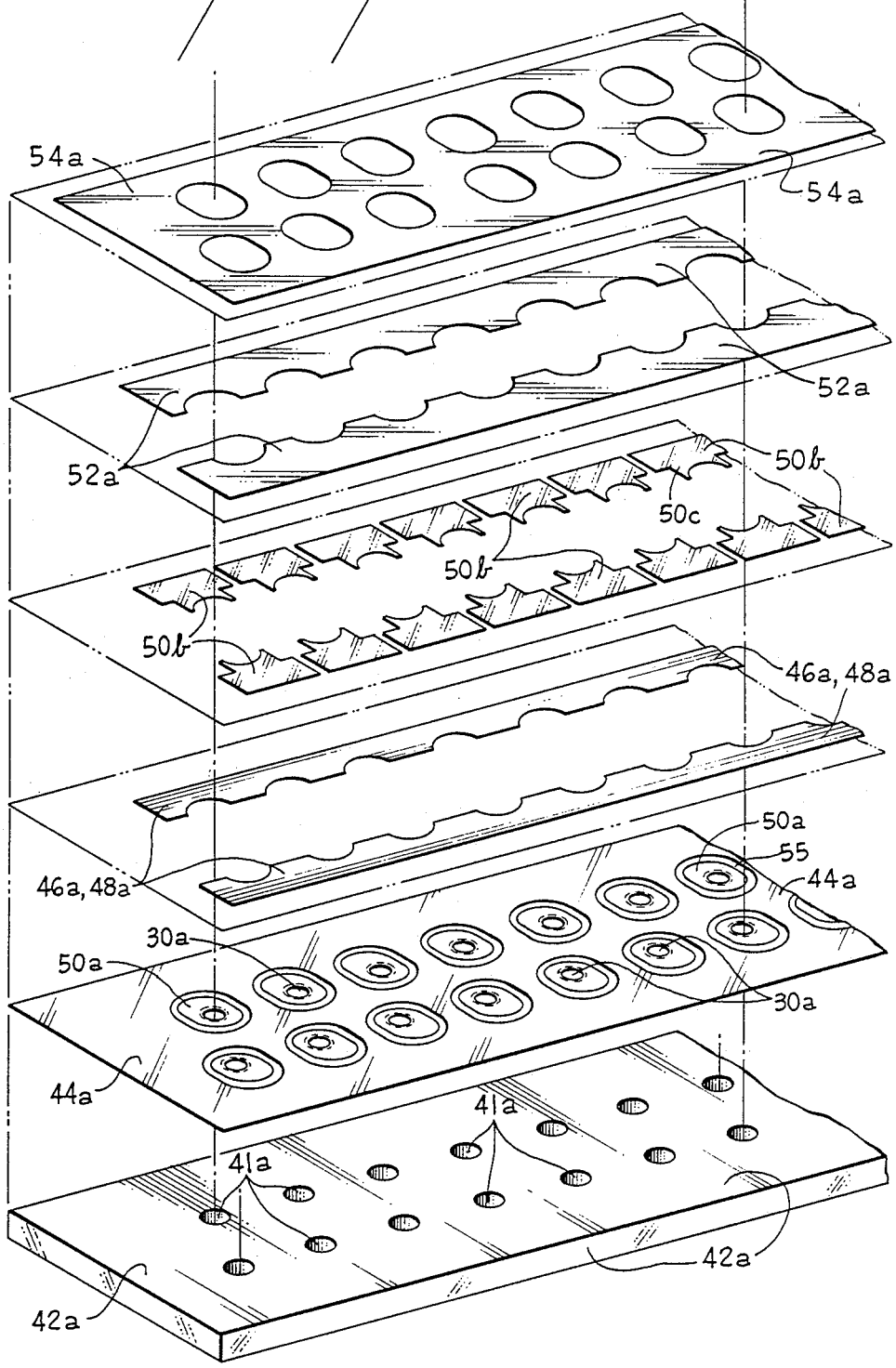
FIG. 10 is an exploded view of the components for the preferred embodiment of the present invention.
Figure 11:
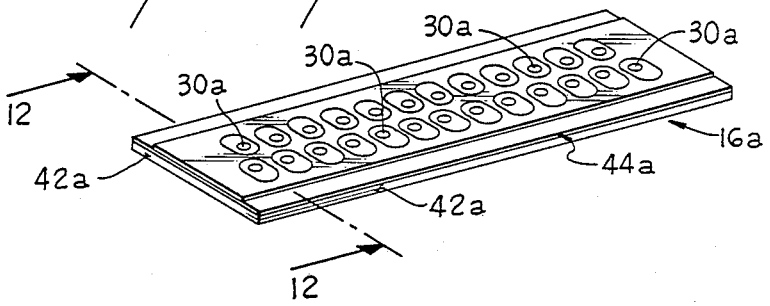
Figure 12:
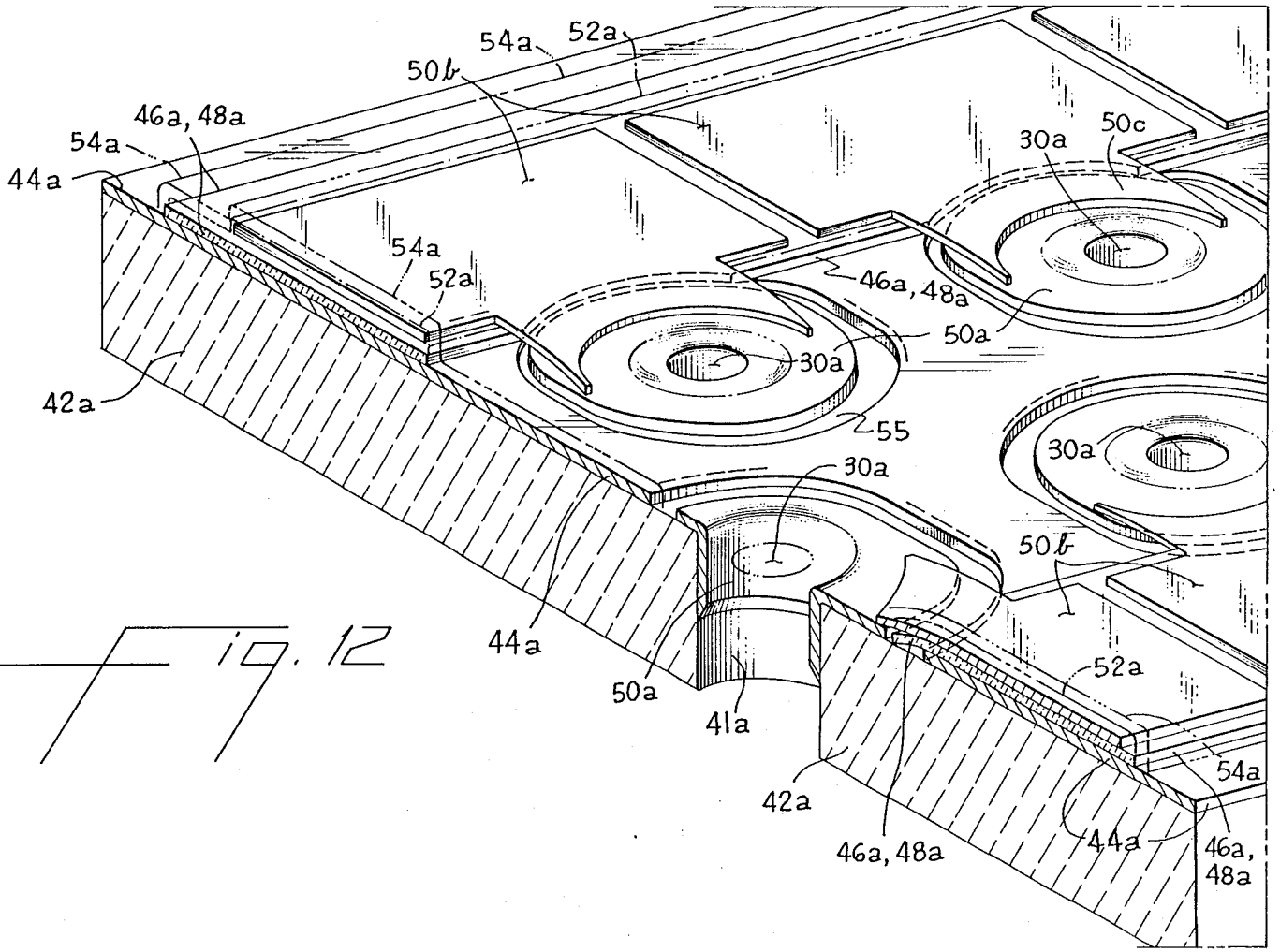
FIG. 12 is a fragmentary perspective of the filter connector shown in FIG. 11, parts having broken away and shown in section to reveal details of construction.

The presently preferred embodiment of the invention is shown in FIGS. 10–12. Metallic layer 44a is screen printed over the entire upper surface of substrate 42a except for oval openings 55 around each hole **41*a*. Similarly shaped metallic layers 50*a* are screen printed on substrate 42*a*, within and spaced from the edges of openings 55. Layers 50*a* extend into holes 41a to form metalized holes 30*a***. *Elongated dielectric layers 46a,* **48*a* are printed outside the staggered rows of holes 30*a*. Cut-outs are provided so that the dielectric layers can extend to and partially surround layers 50*a*. Metallic layers 50*b* have legs 50*c* which extend over a dielectric layer into contact with the discrete layers 50*a*. Legs 50*c* terminate in circular cut-outs in order to merge smoothly into the metallic layers 50*a*, thereby forming an electrically continuous pin electrode consisting of 50*a*, 50*b* and 50*c* which functions in the same manner as the pin electrode 50 of FIGS. 4 and 5. Then, encapsulant layers 52*a*, 54*a* are added. This embodiment is a functional and electrical equivalent of the embodiments shown in FIGS. 4, 4A** and is additionally advantageous because of economies in and ease of fabrication.

Having thus described our invention, what is claimed as new and desired to be secured by Letters Patent is:

1. In an electrical filter connector having a conductive housing, a filter element enclosed within the housing and electrically conductive pins mounted in the filter element, the improvement whereby the filter element comprises an alumina substrate having opposed surfaces as well as through holes in which said pins are mounted and a planar array of closely spaced thick film capacitors formed by screen printing alternate conductive and dielectric layers on one of said surfaces, there being a capacitor associated with a respective pin, a first of said layers being a thick film metallization forming a ground electrode in electrical contact with the connector housing along two opposite edges, said ground elecrode extending to the periphery of said substrate and being continuous except for holes sufficient in size to allow the conductive pins to pass without touching the electrode, a third of said layers being a thick film metallization forming a discrete pin electrode in electrical contact with each of the pins but not with the housing, and a second of said layers being a thick film dielectric between the electrodes.

2. A filter connector according to claim 1 wherein the ground electrode layer is the first layer applied to the substrate, a secod layer being an insulating dielectric material applied over the ground electrode adjacent each substrate hole but spaced therefrom and a third layer being a thick film metallization forming a discrete pin electrode applied over the second layer around and into each substrate hole, said pins being solder mounted in said holes.

3. A filter connector according to claim 2 wherein a nonconducting encapsulant having a compatible coefficient of expansion is applied over the third layer.

4. A filter connector according to claim 3 wherein the first layer of the planar array of capacitors is a noble metal metallization.

5. A filter connector according to claim 3 wherein the first layer of the planar array of capacitors is a palladium/silver alloy metallization.

6. A filter connector according to claim 3 wherein the third layer of the planar array of capacitors is a noble metal metallization.

7. A filter connector according to claim 3 wherein the third layer of the planar array of capacitors is a palladium/silver alloy metallization.

8. A filter connector according to claim 3 wherein the first layer of the planar array of capacitors is a copper metallization.

9. A filter connector according to claim 3 wherein the third layer of the planar array of capacitors is a copper metallization.

10. A filter connector according to claim 2 wherein the third layer metallization is in the shape of an arrowhead.

11. A filter connector according to claim 1 wherein a ferrite sleeve encloses each conductive pin.

12. In an electrical filter connector having a conductive housing, a filter element enclosed within the housing and electrically conductive pins mounted on the filter element, the improvement whereby the filter element comprises a multiplicity of closely spaced thick film capacitors, each capacitor accommodating a respective single pin in a respective hole through an alumina substrate having opposed, parallel surfaces and each capacitor having alternate conductive and dielectric layers screen printed on the substrate, a first layer being a noble metal metallization forming an electrode grounded to the connector housing along two opposite edges and being continuous except for holes therein sufficient in size to allow the conductive pins to pass without touching the first layer, a second layer being a dielectric insulating material, the second layer substantially covering the first layer and overlapping the first layer around each hole, a third layer being a metallization forming a discrete pin electrode around and in each substrate hole and applied to overlap the second layer and being in electrical contact with each respective pin, and a fourth layer being a nonconducting encapsulant having a coefficient of expansion compatible with the other layers applied over the third layer, said first layer having an exposed border in electrical contact with the housing along two opposite edges.

13. An electrical filter connector having a conductive housing, a filter element enclosed within the housing and electrically conductive pins mounted on the filter element, said filter element comprising a multiplicity of closely spaced thick film capacitors, each capacitor accommodating a respective single pin in a respective hole through an alumina substrate having opposed surfaces and each capacitor having alternate conductive and dielectric layers screen printed on one of said surfaces, a first layer being a noble metal metallization forming a discrete pin electrode applied over said one surface around and within each hole, the first layer being in electrical contact with the respective pin passing therethrough, a second layer being a dielectric insulating material overlapping the first layer, a third layer being a noble metal metallization forming a ground electrode overlapping the second layer, and a fourth layer being a nonconducting encapsulant having a coefficient of expansion compatible with the other layers applied over the third layer, said ground electrode extending to the periphery of said one surface, being continuous except for holes sufficient in size to allow the pins to pass without touching the electrode, and being en electrical contact with said housing along two opposite edges.

14. An electrical filter connector having a conductive housing, a filter element enclosed within the housing and electrically conductive pins mounted on the filter element, said filter element comprising a multiplicity of closely spaced thick film capacitors, each capacitor accommodating a respective single pin in a respective hole through an alumina substrate having opposed surfaces and each capacitor having alternate conductive and dielectric layers screen printed on one of said surfaces, a first layer being a metallization forming an electrode grounded to the connector housing along two opposite edges and being continuous except for openings around each hole in the substrate and also forming a portion of a pin electrode within each opening in the grounded electrode and said portion being in electrical contact with the pin but not with the grounded electrode; a second layer being a thick film dielectirc printed over a substantial portion of the grounded electrode and separating the grounded electrode from the pin electrodes; a third layer being a metallization forming the remainder of each discrete pin electrode and comprising a leg portion which extends over the dielectric layer into contact with the pin electrode portions in the first metallization layer; a fourth layer being a nonconducting encapsulant having a coefficient of expansion compatible with the other layers applied over the third layer.

* * * * *